US010998671B2

(12) United States Patent
Shaw et al.

(10) Patent No.: US 10,998,671 B2
(45) **Date of Patent: *May 4, 2021**

(54) DIMM/EXPANSION CARD RETENTION METHOD FOR HIGHLY KINEMATIC ENVIRONMENTS

(71) Applicant: Crystal Group, Inc., Hiawatha, IA (US)

(72) Inventors: James E Shaw, Ely, IA (US); Brad Patrick McDermott, Hiawatha, IA (US)

(73) Assignee: Crystal Group, Inc., Hiawatha, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/933,443

(22) Filed: Jul. 20, 2020

(65) Prior Publication Data

US 2020/0350726 A1 Nov. 5, 2020

Related U.S. Application Data

(63) Continuation of application No. 16/537,971, filed on Aug. 12, 2019, now Pat. No. 10,734,756.

(60) Provisional application No. 62/717,375, filed on Aug. 10, 2018.

(51) Int. Cl.

| | |
|---|---|
| ***H01R 9/26*** | (2006.01) |
| ***H01R 13/533*** | (2006.01) |
| ***H01R 43/20*** | (2006.01) |
| ***H01R 12/72*** | (2011.01) |
| ***H01R 12/73*** | (2011.01) |

(52) U.S. Cl.
CPC ..... *H01R 13/533* (2013.01); *H01R 12/721* (2013.01); *H01R 12/737* (2013.01); *H01R 43/205* (2013.01)

(58) Field of Classification Search
CPC ..... H01R 9/26; H01R 9/2675; H01R 9/2408; H01R 27/00; H01R 103/00
USPC ..... 439/716, 218, 715, 717, 222; 307/43, 32
See application file for complete search history.

(56) References Cited

U.S. PATENT DOCUMENTS

| | | | |
|---|---|---|---|
| 3,150,906 | A | 9/1964 | Jacques et al. |
| 3,360,689 | A | 12/1967 | Haury |
| 5,074,800 | A | 12/1991 | Sasao et al. |
| 5,419,712 | A | 5/1995 | Bellomo et al. |
| 5,443,394 | A | 8/1995 | Billman et al. |
| 5,603,625 | A | 2/1997 | Tondreault |
| 6,007,357 | A | 12/1999 | Perino et al. |
| 6,030,251 | A | 2/2000 | Stark et al. |
| 6,045,385 | A | 4/2000 | Kane |
| 6,394,831 | B1 | 5/2002 | Bowers et al. |
| 6,517,369 | B1 | 2/2003 | Butterbaugh et al. |
| 6,545,877 | B1 | 4/2003 | Agha et al. |
| 6,589,059 | B2 | 7/2003 | Perino et al. |
| 6,611,058 | B2 | 8/2003 | Kinsman et al. |
| 6,767,230 | B2 | 7/2004 | Lai |

(Continued)

*Primary Examiner* — Phuong Chi Thi Nguyen
(74) *Attorney, Agent, or Firm* — Simmons Perrine Moyer Bergman PLC

(57) ABSTRACT

A system and method for stabilizing a DIMM in a DIMM connector so as to reduce wear related electrical disconnections therebetween. A base is disposed between adjacent DIMM connectors and is coupled to the motherboard. A cap engages a top edge of a plurality of DIMMs and an adjustable force is applied to the top of the DIMMS by turning a screw which extends from the cap into the base.

20 Claims, 4 Drawing Sheets

(56) References Cited

U.S. PATENT DOCUMENTS

| | | | |
|---|---|---|---|
| 7,371,097 | B1 | 5/2008 | Pennypacker et al. |
| 7,637,748 | B2 | 12/2009 | Chung et al. |
| 7,922,506 | B1 | 4/2011 | Harlan et al. |
| 7,955,100 | B2 | 6/2011 | Chung et al. |
| 8,075,330 | B1 | 12/2011 | Deng et al. |
| 8,113,863 | B2 | 2/2012 | Vrenna et al. |
| 8,403,689 | B2 | 3/2013 | Li et al. |
| 8,559,187 | B2 | 10/2013 | Peng et al. |
| 8,665,587 | B2 | 3/2014 | Peng et al. |
| 8,771,001 | B2 | 7/2014 | Li et al. |
| 9,060,453 | B2 | 6/2015 | Cox et al. |
| 9,172,164 | B2 | 10/2015 | Tang et al. |
| 9,173,310 | B2 | 10/2015 | Crippen et al. |
| 10,734,756 | B2 * | 8/2020 | Shaw ..... H01R 43/205 |
| 2003/0090879 | A1 | 5/2003 | Doblar et al. |
| 2006/0055017 | A1 | 3/2006 | Cho et al. |
| 2006/0126369 | A1 | 6/2006 | Raghuram |
| 2006/0129712 | A1 | 6/2006 | Raghuram |
| 2006/0129755 | A1 | 6/2006 | Raghuram |
| 2007/0118692 | A1 | 5/2007 | Yu |
| 2007/0136523 | A1 | 6/2007 | Bonella et al. |
| 2007/0161275 | A1 | 7/2007 | McBroom et al. |
| 2007/0189098 | A1 | 8/2007 | Hsieh |
| 2007/0283054 | A1 | 12/2007 | Burton |
| 2007/0287333 | A1 | 12/2007 | Shan et al. |
| 2008/0007921 | A1 | 1/2008 | Pauley et al. |
| 2008/0068900 | A1 | 3/2008 | Bhakta et al. |
| 2008/0140952 | A1 | 6/2008 | Lee et al. |
| 2008/0155211 | A1 | 6/2008 | Misbach |
| 2008/0180899 | A1 | 7/2008 | Pearson et al. |
| 2008/0207059 | A1 | 8/2008 | Shan et al. |
| 2009/0034327 | A1 | 2/2009 | Yun et al. |
| 2009/0077293 | A1 | 3/2009 | Kerrigan et al. |
| 2009/0119451 | A1 | 5/2009 | Haywood et al. |
| 2009/0180260 | A1 | 7/2009 | Djordjevic |
| 2009/0201711 | A1 | 8/2009 | Solomon et al. |
| 2009/0211083 | A1 | 8/2009 | Bodenweber et al. |
| 2009/0217102 | A1 | 8/2009 | Co |
| 2010/0008034 | A1 | 1/2010 | Hinkle |
| 2010/0042778 | A1 | 2/2010 | Tanguay et al. |
| 2010/0091540 | A1 | 4/2010 | Bhakta et al. |
| 2010/0128507 | A1 | 5/2010 | Solomon et al. |
| 2010/0191904 | A1 | 7/2010 | Misbach |
| 2011/0016268 | A1 | 1/2011 | Qawami et al. |
| 2011/0029746 | A1 | 2/2011 | Lee et al. |
| 2011/0085406 | A1 | 4/2011 | Solomon et al. |
| 2011/0090749 | A1 | 4/2011 | Bhakta et al. |
| 2011/0099317 | A1 | 4/2011 | Nishtala et al. |
| 2011/0246743 | A1 | 10/2011 | Lee et al. |
| 2011/0286175 | A1 | 11/2011 | Iyengar et al. |
| 2011/0286179 | A1 | 11/2011 | Motschman et al. |
| 2012/0151287 | A1 | 6/2012 | Le et al. |
| 2012/0271990 | A1 | 10/2012 | Chen et al. |
| 2012/0278524 | A1 | 11/2012 | Lee et al. |
| 2013/0007356 | A1 | 1/2013 | Liu et al. |
| 2013/0019048 | A1 | 1/2013 | Bland et al. |
| 2013/0070410 | A1 | 3/2013 | Chen et al. |
| 2013/0074339 | A1 | 3/2013 | Boraas et al. |
| 2013/0114200 | A1 | 5/2013 | Wu et al. |
| 2013/0135812 | A1 | 5/2013 | Barina et al. |
| 2013/0151904 | A1 | 6/2013 | Le et al. |
| 2013/0290589 | A1 | 10/2013 | Liu et al. |
| 2014/0040569 | A1 | 2/2014 | Solomon et al. |
| 2014/0095781 | A1 | 4/2014 | Qawami et al. |
| 2014/0185227 | A1 | 7/2014 | Wu et al. |
| 2014/0211404 | A1 | 7/2014 | Yang |
| 2014/0241062 | A1 | 8/2014 | Jeseritz et al. |
| 2015/0004824 | A1 | 1/2015 | Nguyen et al. |
| 2015/0011100 | A1 | 1/2015 | Stock et al. |
| 2015/0031232 | A1 | 1/2015 | Kerrigan et al. |
| 2015/0033550 | A1 | 2/2015 | Boraas et al. |
| 2015/0089279 | A1 | 3/2015 | Dodson et al. |
| 2015/0127890 | A1 | 5/2015 | Brainard et al. |
| 2015/0169238 | A1 | 6/2015 | Lee et al. |
| 2015/0245529 | A1 | 8/2015 | Tam et al. |
| 2015/0363107 | A1 | 12/2015 | Best et al. |
| 2016/0011802 | A1 | 1/2016 | Berke |
| 2016/0019138 | A1 | 1/2016 | Lee |
| 2016/0070616 | A1 | 3/2016 | Tavallaei et al. |
| 2016/0071610 | A1 | 3/2016 | Murakami |
| 2016/0081217 | A1 | 3/2016 | Norton et al. |
| 2016/0085670 | A1 | 3/2016 | Huang et al. |
| 2016/0196073 | A1 | 7/2016 | Zhang et al. |
| 2016/0270249 | A1 | 9/2016 | Kidd |
| 2018/0062287 | A1 | 3/2018 | Shaw et al. |
| 2019/0281719 | A1 | 9/2019 | Geng et al. |

* cited by examiner

DIMM/EXPANSION CARD RETENTION METHOD FOR HIGHLY KINEMATIC ENVIRONMENTS

CROSS REFERENCE TO RELATED APPLICATIONS

This application is a continuation of the non-provisional patent application having Ser. No. 16/537,971 filed Aug. 12, 2019, which claims the benefit of the filing date of the provisional patent application having Ser. No. 62/717,375 filed Aug. 10, 2018, the contents of which are incorporated herein in their entirety by this reference.

FIELD OF THE INVENTION

The present invention relates to computer motherboards and secondary perpendicular circuit cards and mechanisms for coupling the same.

BACKGROUND OF THE INVENTION

Server class compute platforms were typically not employed in environments that are harsh, such as military vehicles, construction vehicles, weapons platforms, space launch systems, etc. However, these server platforms are becoming necessary because of the need for virtualization and compute density in smaller spaces. One of several obstacles requiring resolution is the fragility of the Joint Electron Device Engineering Council (JEDEC) style DIMM connector on these compute platforms. This connector is a high speed (electrical speeds in the 2-3 GHz range) interface using a leaf spring style contact which creates a line of surface electrical conduction where the spring side of the connector touches the circuit side of the DIMM via a gold plated pad on the circuit card. See FIG. 2.

While a DIMM is latched into a JEDEC DIMM connector, and vibration is imparted on the masses of the compute platform, relative movement often occurs between the leaf spring style contacts and their corresponding gold plated pads on the DIMM which degrade the ability to maintain contact with the circuit card housing the memory chips. In demanding environments over time, the spring contact and the circuit card lose electrical connectivity when at least one of the leaf spring style contacts and/or its respective gold plated pad becomes so worn as to no longer make an electrical connection therebetween.

Consequently, there exists a need for improved methods and systems for connecting JEDEC memory modules in a compute platform used in harsh environments, such as military vehicles, weapons platforms, and space launch systems, all done in a reliable and cost efficient manner.

SUMMARY OF THE INVENTION

It is an object of the present invention to provide a system and method for connecting memory modules via a DIMM connector in an efficient manner.

It is a feature of the present invention to utilize a multi-DIMM top edge cap.

It is an advantage of the present invention to reduce inadvertent electrical disconnection of memory modules from a DIMM connector.

It is another feature of the present invention to include an interstitial base for biasing the cap toward the motherboard.

It is another advantage of the present invention to reduce relative movement between DIMM connector and the DIMM.

The present invention is an apparatus and method for making more robust the connections between a memory module and a JEDEC style DIMM connector to satisfy the aforementioned needs, provide the previously stated objects, include the above-listed features, and achieve the already articulated advantages. The present invention is carried out in a "DIMM gold pad destruction-less" manner in a sense that the degradation of the gold pad to leaf spring like contact connection has been greatly reduced.

Accordingly, the present invention is a system for reducing inadvertent electrical disconnection of memory modules during operation in harsh environments comprising:

- a parallel plurality of adjacent dual in-line memory module (DIMM) connectors, each having a connector longitudinal axis, being disposed on a motherboard with a gap therebetween;
- a parallel plurality of adjacent DIMMs each having a memory module top edge and a memory module longitudinal axis;
- a multi-DIMM vibration damping cap having a cap longitudinal axis and a parallel plurality of cap to memory module top edge engaging regions;
- a base, having a base longitudinal axis, said base disposed in said gap and coupled to one of:
  - the motherboard;
  - one of the parallel plurality of adjacent DIMM connectors; and
  - a coupler biasing said multi-DIMM vibration damping cap toward a parallel plurality of memory module top edges.

Accordingly, the present invention is a method of reducing inadvertent electrical disconnection of circuit boards during operation in harsh environments comprising:

- providing a plurality of adjacent connectors, each having a connector longitudinal axis, being disposed on a first circuit board with a gap therebetween;
- providing a plurality of adjacent circuit cards each having a circuit card top edge and a circuit card longitudinal axis;
- proving a cap having a cap longitudinal axis and a plurality of cap to circuit card top edge engaging regions;
- providing a base having a base longitudinal axis, said base disposed in said gap and coupled to one of:
  - the primary circuit card;
  - one of the parallel plurality of adjacent connectors; and
  - providing a coupler biasing said cap toward a plurality of secondary circuit card top edges.

BRIEF DESCRIPTION OF THE DRAWINGS

The invention may be more fully understood by reading the following description of the preferred embodiments of the invention, in conjunction with the appended drawings wherein.

DETAILED DESCRIPTION

Through this description details are given of a motherboard, DIMM and a DIMM connector, it should be understood that different circuit cards with different types of electronic components could be used with different connector sizes and configurations. It is intended that these specific details not limit the scope of the present invention, unless repeated in the claims, but instead fully enable a specific and/or best mode of the invention and other variations of this card and connector types are intended to be readily understood from the following description and included within the scope and spirit of the present invention.

Figure 1:
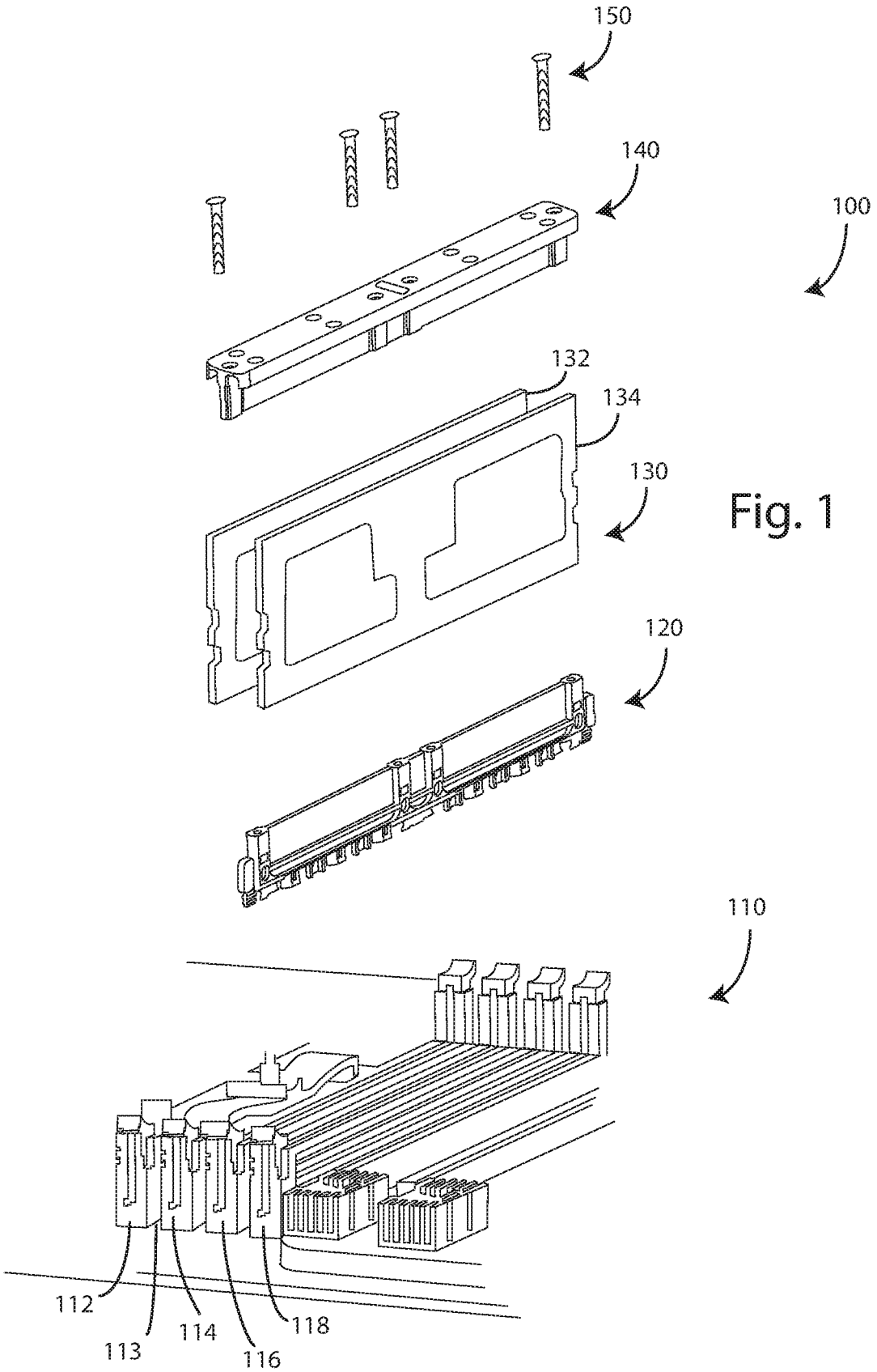
FIG. 1 is an exploded perspective view of present invention in its intended environment.

Now referring to the drawings wherein like numerals refer to like matter throughout, and more specifically referring to FIG. 1, there is shown a DIMM stabilization system 100, of the present invention which includes a motherboard 110 or other primary circuit board which receives secondary circuit boards in a perpendicular orientation. Mounted on motherboard 110 are: first DIMM connector 112, second DIMM connector 114, third DIMM connector 116, and fourth DIMM connector 118. First to second gap 113 is the gap located between first DIMM connector 112 and second DIMM connector 114.

Base 120 is shown, in this exploded view, above first to second gap 113 where it would be installed during assembly of the present invention.

Adjacent parallel DIMM pair 130, which includes first DIMM 132 and second DIMM 134, which are configured to be inserted into first DIMM connector 112, and second DIMM connector 114, respectively.

Multi-DIMM vibration damping cap 140 is shown above adjacent parallel DIMM pair 130 and would engage the top edge of first DIMM 132 and second DIMM 134 when fully assembled.

Biasing force adjustment system 150 is shown above multi-DIMM vibration damping cap 140.

Figure 2:
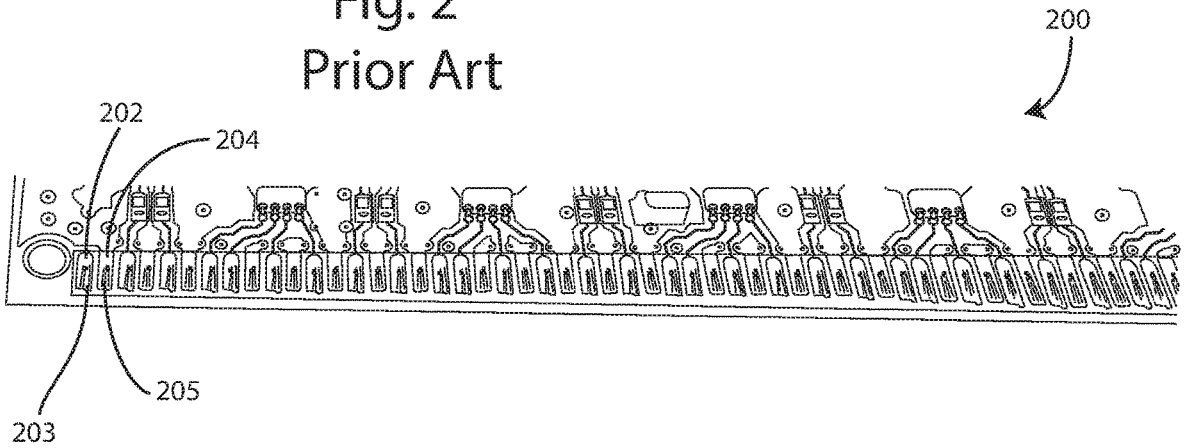
Fig. 2 Prior Art
FIG. 2 is a perspective view of a damaged portion of a DIMM of the prior art.

Now referring to FIG. 2, there is shown a prior art DIMM contact region 200 of a typical prior art DIMM, which includes prior art DIMM contact first pad 202 and prior art DIMM contact second pad 204. Also shown are prior art DIMM contact first vibration damaged region 203 and prior art DIMM contact second vibration damaged region 205 on prior art DIMM contact first pad 202 and prior art DIMM contact second pad 204, respectively. If the severity of the wear in prior art DIMM contact first vibration damaged region 203 or prior art DIMM contact second vibration damaged region 205 continues to grow until even just one contact is no longer electrically connected, the DIMM will fail to function properly.

Figure 3:
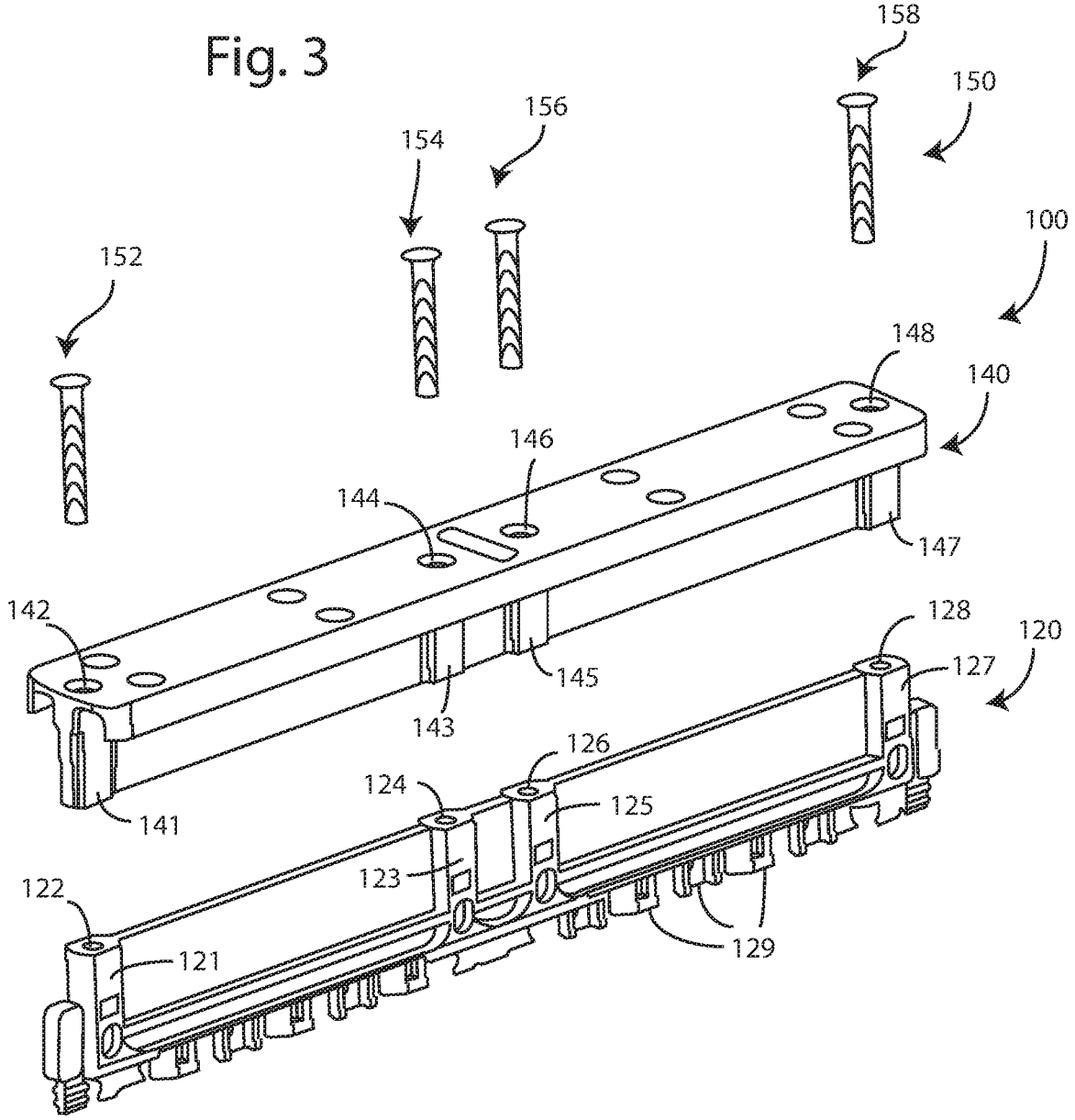
FIG. 3 is a close up exploded view of components of the present invention.
Figure 4:
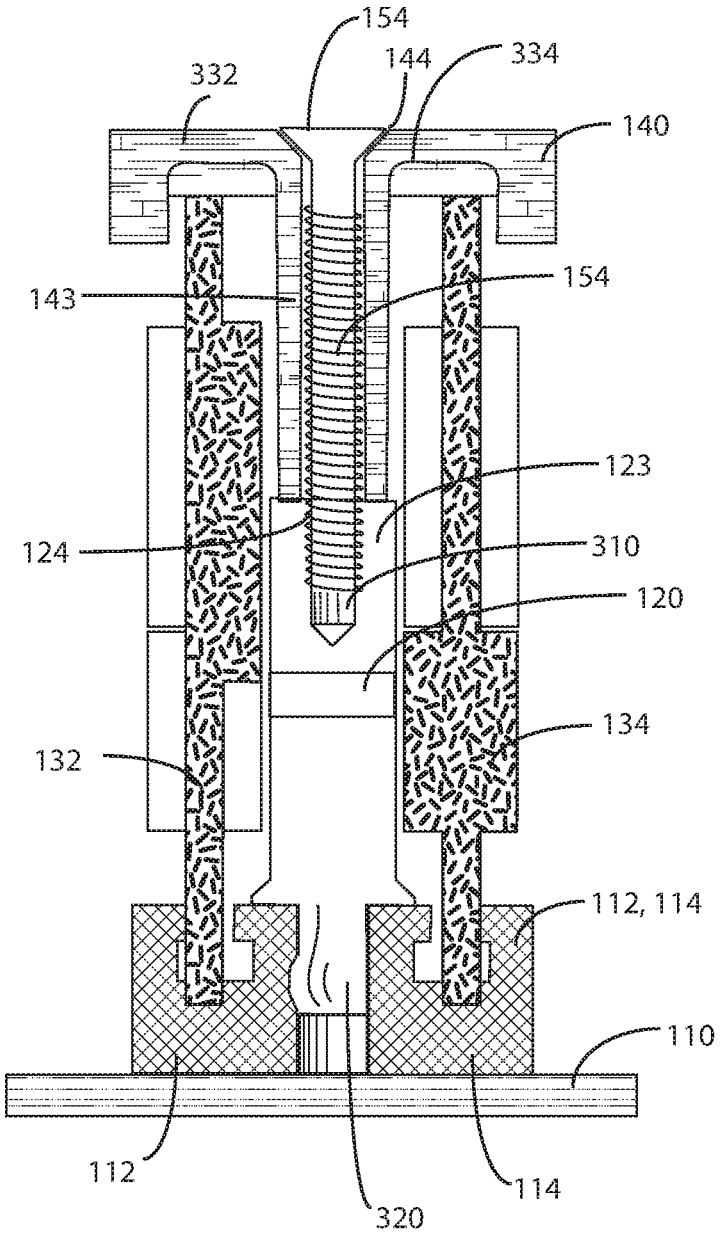
FIG. 4 is a cross-sectional view of the present invention in its intended environment.

Now referring to FIG. 3, there is shown an exploded view of the DIMM stabilization system 100 of the present invention, which could be assembled as follows: base 120 is mounted to the motherboard 110 in the first to second gap 113 using a preferably non-electrically conductive base mounting adhesive 320 (FIG. 4). In an embodiment where the base 120 is mounted to the motherboard 110 using adhesive, the base 120 can be designed to prevent contamination of the first DIMM connector 112 and second DIMM connector 114 by creating a lip and specifically designed flow paths. Base 120 is shown with base self-centering spring members 129 and bonding enhancement features to allow for the base 120 to be centered between first DIMM connector 112 and second DIMM connector 114 and to thoroughly bond with them and/or the motherboard 110. An acceptable range of separation between first DIMM connector 112 and second DIMM connector 114 will determine the necessary dimensions and flexibility characteristics of base self-centering spring members 129. Base 120 is shown with first base screw mating region 121, second base screw mating region 123, third base screw mating region 125, fourth base screw mating region 127, which all can be integrated threading in base 120 or could be threaded inserts, such as screw mating threads 310 (FIG. 4). In an assembled configuration, first base screw receiving region 122, second base screw receiving region 124, third base screw receiving region 126 and fourth base screw receiving region 128 are adjacent to and aligned with first cap screw passage 141, second cap screw passage 143, third cap screw passage 145, and fourth cap screw passage 147, respectively of the multi-DIMM vibration damping cap 140. The materials for base 120 and multi-DIMM vibration damping cap 140 may be, in some embodiments, preferably relatively stiff so as to provide a vibration and deflection decreasing beneficial increase in overall stiffness of the motherboard 110 when the DIMM stabilization system 100 is fully assembled and adjusted. Biasing force adjustment first screw 152, biasing force adjustment second screw 154, biasing force adjustment third screw 156, and biasing force adjustment fourth screw 158 are inserted into first cap screw head receiving region 142, second cap screw head receiving region 144, third cap screw head receiving region 146 and fourth cap screw head receiving region 148, respectively. When the DIMM stabilization system 100 is assembled, it provides a continuous downward (toward the motherboard 110) pressure on the adjacent parallel DIMM pair 130. Ideally, the only portion of DIMM stabilization system 100 that touches the adjacent parallel DIMM pair 130 is the cap to memory module top edge engaging first region 332 and cap to memory module top edge engaging second region 334 (FIG. 4). These regions may be provided with an injection molded pad, elastomer coating, or suitable substitute which aid in absorbing vibration and improves clamping capability of the system.

Now referring to FIG. 4, there is shown a cross-sectional view of the DIMM stabilization system 100 in a fully assembled and adjusted state.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A system for reducing inadvertent electrical disconnection of memory modules during operation in harsh environments comprising:

a parallel plurality of adjacent dual in-line memory module (DIMM) connectors, each having a connector longitudinal axis, being disposed on a motherboard with a gap therebetween;

a parallel plurality of adjacent DIMMs each having a memory module top edge and a memory module longitudinal axis;

a multi-DIMM vibration damping cap having a cap longitudinal axis and a parallel plurality of cap to memory module top edge engaging regions;

a base, having a base longitudinal axis, said base disposed in said gap and coupled to one of:

the motherboard;

one of the parallel plurality of adjacent DIMM connectors; and a coupler biasing said multi-DIMM vibration damping cap toward a parallel plurality of memory module top edges.

2. The system of claim 1 wherein said coupler comprises an elongated threaded member.

3. The system of claim 1 wherein said base further comprises a top edge and a bottom edge, said top edge configured to support from below a bottom portion of said multi-DIMM vibration damping cap.

4. The system of claim 3 wherein said base further comprises a plurality of base self-centering spring members.

5. The system of claim 4 wherein said multi-DIMM vibration damping cap further comprises an elastomer region for engaging said memory module top edge.

6. The system of claim 5 wherein said base is coupled to said motherboard with a non-electrically conductive adhesive.

7. The system of claim 4 wherein said base self-centering spring members comprises a plurality of flexible tabs balanced, along a portion of said bottom edge of said base, from side to side to assist in centering the base in the interstitial gap.

8. The system of claim 7 wherein said bottom edge of said base is further configured with surface features to control the flow of adhesive and to protect a DIMM connector from contamination by adhesive.

9. The system of claim 8 wherein said multi-DIMM vibration damping cap is constructed so that when secured to the base, an increase in stiffness of portions of the motherboard occurs.

10. A system for reducing inadvertent electrical disconnection of circuit boards during operation in harsh environments comprising:

a plurality of adjacent connectors, each having a connector longitudinal axis, being disposed on a first circuit board with a gap therebetween;

a plurality of circuit cards each having a circuit card top edge and a circuit card longitudinal axis;

a cap having a cap longitudinal axis and a plurality of cap to circuit card top edge engaging regions;

a base having a base longitudinal axis, said base disposed in said gap and coupled to one of:

the first circuit board;

one of the plurality of adjacent connectors; and a coupler biasing said cap toward a plurality of circuit card top edges.

11. The system of claim 10 wherein said cap is constructed so that when secured to the base, an increase in stiffness of portions of the motherboard occurs.

12. The system of claim 10 wherein said coupler comprises an elongated threaded member.

13. The system of claim 12 wherein said base further comprises a top edge and a bottom edge, said top edge configured to support from below a bottom portion of said cap.

14. The system of claim 10 wherein said base further comprises a plurality of base self-centering spring members.

15. The system of claim 14 wherein said cap further comprises an elastomer region for engaging said memory module top edge.

16. The system of claim 15 wherein said base is coupled to said first circuit board with a non-electrically conductive adhesive.

17. The system of claim 16 wherein said base self-centering spring members comprises a plurality of flexible tabs balanced, along a portion of said bottom edge of said base, from side to side to assist in centering the base in the gap.

18. The system of claim 17 wherein said bottom edge of said base is further configured with surface features to control the flow of adhesive and to protect a DIMM connector from contamination by adhesive.

19. A method of reducing inadvertent electrical disconnection of circuit boards during operation in harsh environments comprising:

providing a plurality of connectors, each having a connector longitudinal axis, being disposed on a primary circuit card with a gap therebetween;

providing a plurality of circuit cards each having a circuit card top edge and a circuit card longitudinal axis;

providing a cap having a cap longitudinal axis and a plurality of cap to circuit card top edge engaging regions;

providing a base having a base longitudinal axis, said base disposed in said gap and coupled to one of:

the primary circuit card;

one of the plurality of connectors; and providing a coupler biasing said cap toward a plurality of secondary circuit card top edges.

20. The method of claim 19 wherein said step of biasing comprises the steps of:

providing an elongated threaded member; and turning said elongated threaded member.

* * * * *